United States Patent [19]

Bayh, III

[11] Patent Number: 4,749,341

[45] Date of Patent: Jun. 7, 1988

[54] METHOD AND SYSTEM FOR SUPPORTING A WELL PUMP

[75] Inventor: Russell I. Bayh, III, Carrollton, Tex.

[73] Assignee: Otis Engineering Corporation, Dallas, Tex.

[21] Appl. No.: 913,106

[22] Filed: Sep. 29, 1986

[51] Int. Cl.[4] ..... F04B 47/06; F16B 21/00; E21B 19/02

[52] U.S. Cl. ..... 417/360; 166/214; 166/237; 166/317; 166/385; 403/331; 417/423 R

[58] Field of Search ..... 415/501; 417/360, 423 L, 417/423 K, 422, 424; 166/385, 77, 115, 117.5, 136, 206, 214, 237, 317, 319, 68, 105; 403/341, 331, 165

[56] References Cited

U.S. PATENT DOCUMENTS

| | | | |
|---|---|---|---|
| 1,547,195 | 7/1925 | Arbon | 403/165 |
| 1,598,701 | 9/1926 | Bell | 403/165 |
| 2,673,614 | 3/1954 | Miller | 166/136 X |
| 2,751,022 | 6/1956 | Baker et al. | 166/317 |
| 2,862,564 | 12/1958 | Bostock | 166/237 X |
| 3,005,494 | 10/1961 | Daffin | 166/136 |
| 3,853,430 | 12/1974 | O'Rourke | 166/217 X |
| 3,994,338 | 11/1976 | Hix | 166/317 X |
| 4,128,735 | 12/1978 | Zehren | 417/422 X |
| 4,149,593 | 4/1979 | Gazda et al. | 166/113 |
| 4,171,934 | 10/1979 | Zehren | 417/360 |
| 4,363,359 | 12/1982 | Taylor et al. | 166/126 X |
| 4,664,187 | 5/1987 | Weinberg | 166/115 |

FOREIGN PATENT DOCUMENTS

| | | | |
|---|---|---|---|
| 991031 | 1/1983 | U.S.S.R. | 166/319 |

*Primary Examiner*—Leonard E. Smith
*Attorney, Agent, or Firm*—Vinson & Elkins

[57] ABSTRACT

A well pump suspended from a mandrel in a well which is run on a cable placed in tension after the pump supporting mandrel is landed. The mandrel is latched in the well and a much greater force is required to release the mandrel from the tubing than was required to move the mandrel to the latched position. The cable includes multiple wire drum sockets which are moved laterally into recesses in the supporting mandrel and held in place by a moveable sleeve. A space out is provided between the mandrel and the cable. The conductors of the cable are brought out of the space out structure to the exterior of the mandrel and extend down through a penetrator which forms a part of the mandrel. The space out structure, the connection between the space out structure and cable, and the mandrel and penetrator components, and the pump are all held against relative rotation to avoid damage to the conductors.

13 Claims, 7 Drawing Sheets

METHOD AND SYSTEM FOR SUPPORTING A WELL PUMP

This invention relates to well pumps and, more particularly, to a method and system for supporting a well pump in a tubing.

In the past, well pumps have been run into tubings on electrical cables and landed at a selected level in the well. It has been conventional to latch the pump supporting mandrel in place with a latch released by an upward pull. See U.S. Pat. No. 3,853,430. It has also been proposed to use shear pins to hold the mandrel in place. Such pins are sheared by an upward pull. See U.S. Pat. No. 4,121,659.

Rotation prevention devices are commonly employed on cable run pumps. See, for instance, U.S. Pat. No. 4,363,359. In the testing art, U.S. Pat. No. 4,149,593 discloses a stinger which is more difficult to remove than to insert.

An object of this invention is to provide a method and system for supporting a pump in a tubing in which the electric cable extending upwardly from the pump is maintained in tension to prevent damage to the cable.

Another object is to provide a pump supporting mandrel with a collet, which latches in a groove in a landing nipple and in which the collet is more difficult to pull out of the groove than to insert into the landing nipple, so that the cable may be placed in tension to protect it from damage without releasing the collet.

Another object is to provide a mandrel for supporting a pump in which the mandrel is formed of multiple sections, which are latched against relative rotation and is secured to the cable in a manner which prevents relative rotation between the cable and mandrel, to prevent damage to the conductors which are positioned exterior of and extend through portions of the mandrel and down to the pump, which is located below the mandrel.

Another object is to provide a connection between a multiwire rope cable and a mandrel in which the mandrel has multiple exterior recesses and drum sockets on the end of the cable are received in said recesses and held in place by a releasable sleeve.

Another object is to provide a connection as in the preceding object in which the drum sockets are held against rotation relative to the mandrel.

Another object is to provide a connector between a mandrel and multiwire rope cable in which the cable has at least one flat side on one end and in which the wire ropes are connected to the mandrel as in the preceding object and the mandrel is connected to the cable in a manner preventing rotation therebetween.

Other objects, features and advantages of this invention will be apparent from the drawings, specification and claims.

In the drawings, wherein an illustrative embodiment of this invention is shown and wherein like numerals indicate like parts, FIG. 1 is a schematic view, partly in section and partly in elevation, illustrating a pump supported in a well in accordance with this invention;

Figure 1:
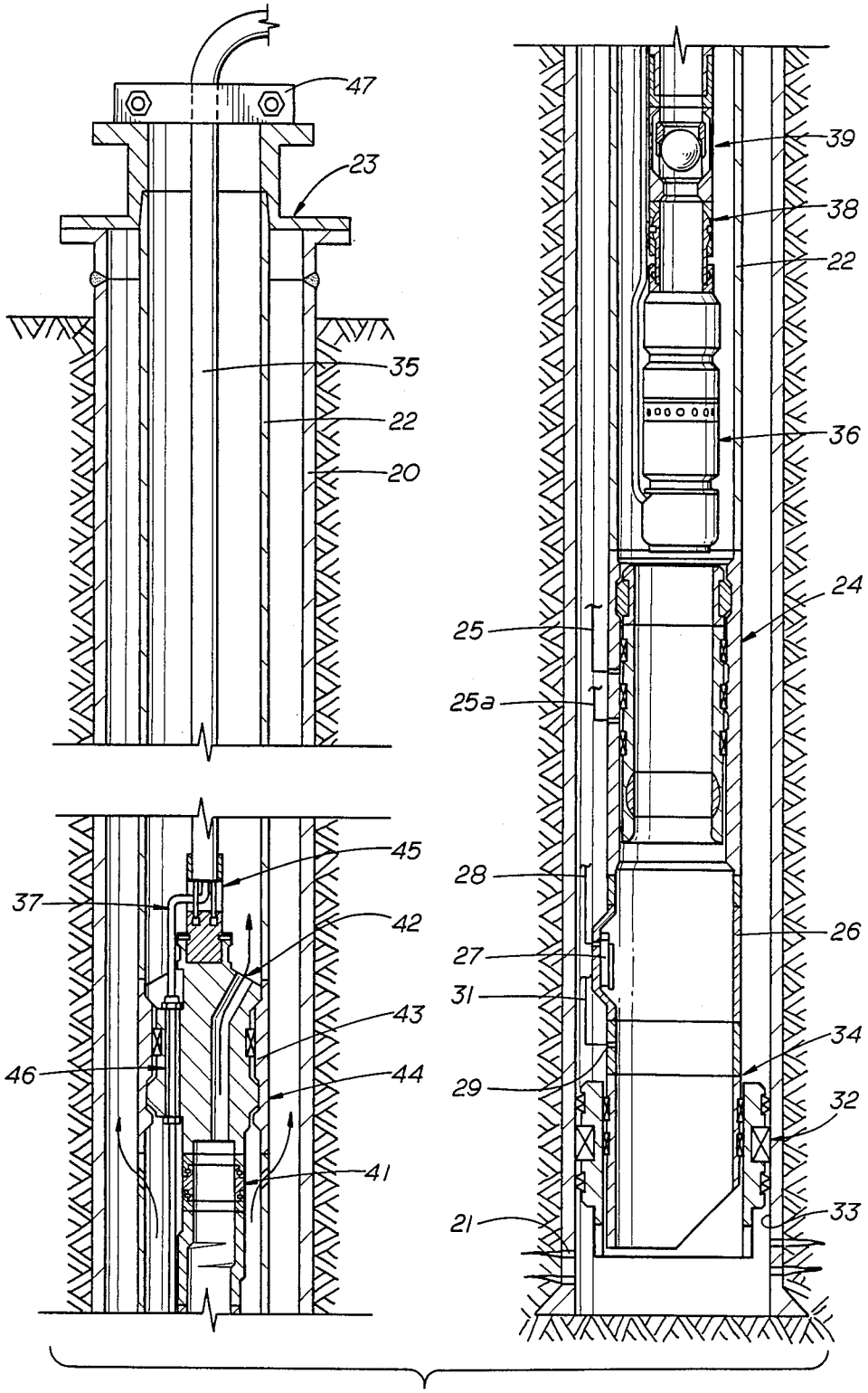

Referring to FIG. 1, the installation shown includes the casing 20 which is perforated at 21 at the producing formation. While the perforations are shown adjacent to the equipment, they may be some distance below the equipment.

Within the well, a tubing 22 is suspended from the wellhead indicated generally at 23. Run as an integral part of the tubing is the subsurface safety valve indicated generally at 24, which is controlled by the lines 25 and 25a, which convey hydraulic pressure from the surface in the conventional manner.

Below the subsurface safety valve, a side pocket mandrel 26 is provided to permit an optional pressure sentry 27, if desired. This sentry communicates with the surface through line 28.

The side pocket mandrel may also provide a port 29 to which a line 31 may be connected to provide for optional chemical injection.

A previously run packer, indicated generally at 32, provides a seal bore 33. On the bottom of the tubing, a dynamic seal unit indicated generally at 34 seals with the seal bore 33.

Suspended within the tubing 22 from the multiconductor multiwire rope cable 35 is the pump indicated generally at 36. This pump may take any desired form and is preferably standard off-the-shelf equipment driven by power through the electrical conductors indicated generally at 37.

Between the cable 35 and the pump 36, several pieces of equpiment are provided. Immediately above the pump, a swivel connector indicated generally at 38 is provided to permit articulation during introduction of the pump into the well. This swivel sub is preferably the sub shown in U.S. Pat. No. 4,425,965. Immediately above the swivel sub there is provided a test and kill valve system, indicated generally at 39, which permits pressuring up the tubing to test and make certain that seals are functioning properly. This system also permits emergency opening of a valve to by-pass the test valve and kill the well.

Above the valve 39 there is provided an indexing union indicated generally at 41 to properly orient the equipment. Above this indexing union 41, a mandrel, indicated generally at 42, provides for sealing of the mandrel in the smooth bore 43 of the landing nipple indicated generally at 44 and for latching the mandrel in the landing nipple 44 to support the pump in the well and to maintain the mandrel in position against a selected upward force. At its upper end, the mandrel is provided with a system indicated generally at 45 for securing the mandrel to the wire ropes of the cable 35. The electrical conductors 37 extend down through a penetrator indicated generally at 46 in the mandrel at the seal section.

By running and locking the mandrel in place against an upward force below a selected amount, the cable 35 may be placed in tension by a clamp 47, which is secured to the tubing 22 through the wellhead 23, to clamp the upper end of the cable 35 in place at the wellhead with the cable below the clamp 47 maintained in tension below said selected force. This will prevent damage to the cable which has occurred in the past due to the weight of the cable, tending to bend the cable adjacent its attachment with the upper end of the mandrel 42.

Figure 2A:
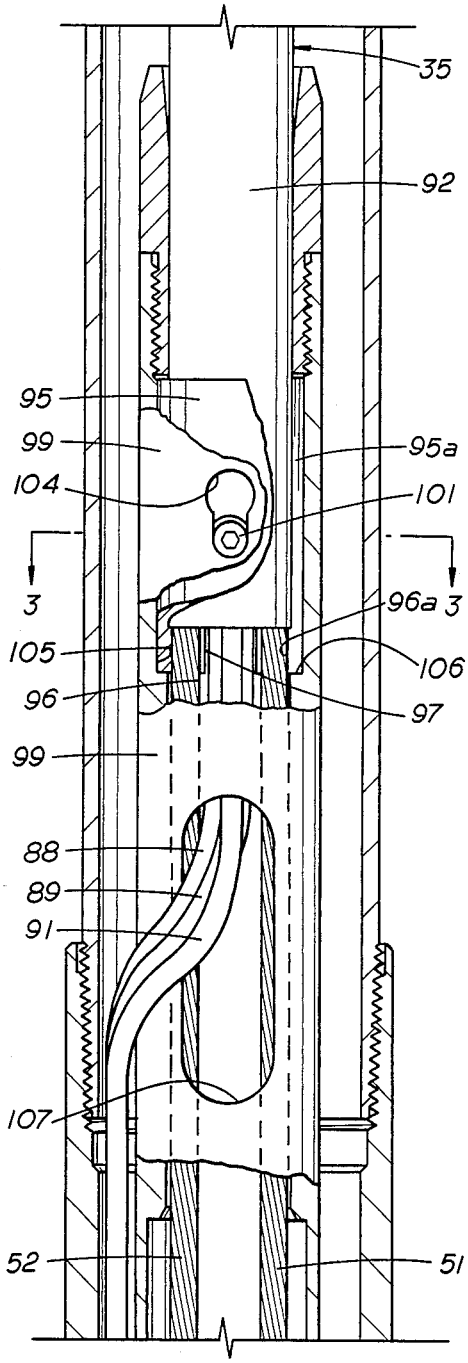
FIGS. 2A through 2E are continuation views, partly in elevation and partly in section, illustrating the pump supporting mandrel of this invention.
Figure 2B:
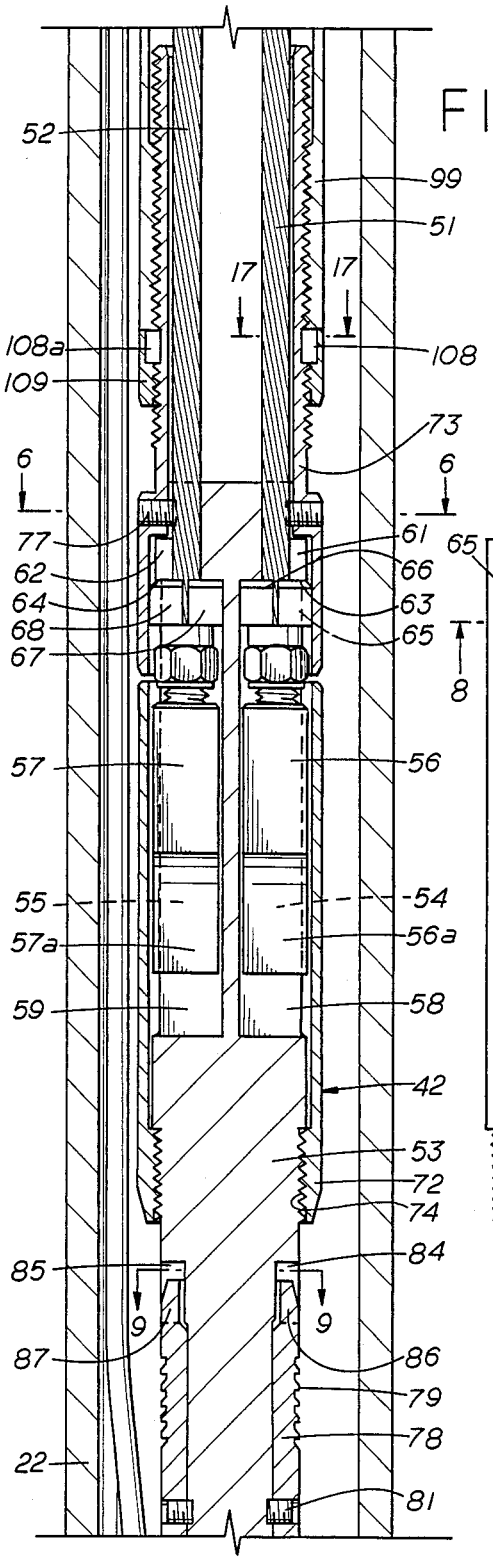
Figure 6:
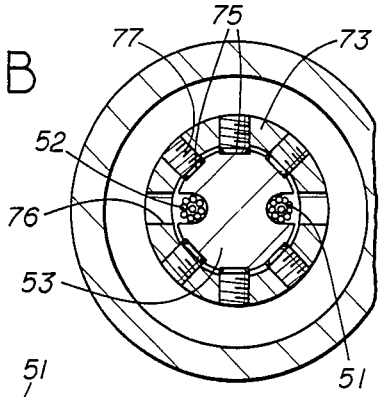
FIG. 6 is a sectional view along the lines 6—6 of FIG. 2B.
Figure 7:
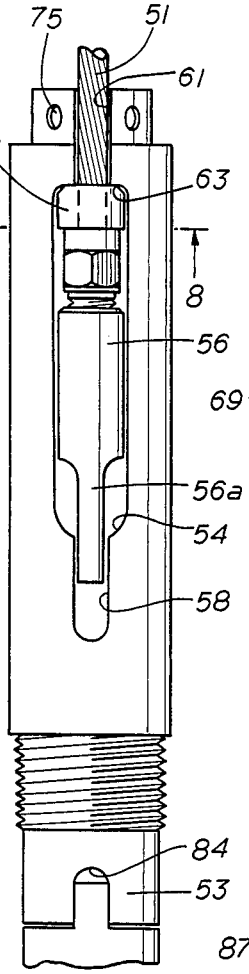
FIG. 7 is a fragmentary view of the mandrel and drum socket shown in FIG. 2B, rotated ninety degrees.
Figure 8:
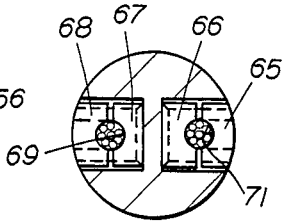
FIG. 8 is a view along the lines 8—8 of FIG. 7.
Figure 9:
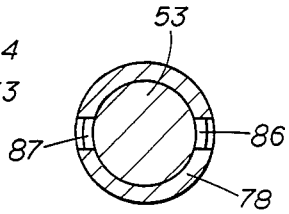
FIG. 9 is a sectional view along the lines 9—9 of FIG. 2B.

In FIG. 2B, the upper end of the mandrel 42 is shown to include a system for securing the mandrel to the wire ropes 51 and 52 of the cable 35. The upper mandrel section 53, is provided with a recess for each wire rope of the cable 35. Preferably, these are two in number and recesses 54 and 55 are provided in opposite sides of the upper mandrel section 53, and as best shown in FIG. 7 open to the outer periphery of the upper mandrel section 53. These recesses 54 and 55 permit the drum sockets 56 and 57 to be movel laterally into the recesses. The drum sockets may take any conventional form provided with means for securing the sockets to the cables. As these are old and well-known, they are not illustrated in the drawings.

It is desirable that the wire ropes not be permitted to unwind when placed in tension and, for this purpose, the recesses 54 and 55 are provided with tang slots 58 and 59 at their lower end into which the tang **56*a* and 57*a* on the lower end of the drum sockets 56 and 57** project, as best shown in FIG. 7.

At their upper ends, the recesses are provided with cable slots 61 and 62, which open to the outer periphery of the upper mandrel section 53 to permit the wire ropes to be moved laterally into these slots, as shown in FIGS. 2B and FIG. 7. At the bottom of these cable slots 61 and 62, the upper mandrel section 53 has downwardly facing tension shoulders 63 and 64 associated with the recesses 54 and 55, respectively.

Interposed between the two drum sockets 56 and 57 and the tension shoulders 63 and 64 are tension transfer blocks 65, 66, 67 and 68. The blocks 66 and 67 are identical and have semi-circular cutouts 69 to receive approximately one-half of a cable. The blocks 65 and 68 are identical and likewise have semi-circular cutouts 71 to receive approximately one-half of a wire rope.

The upper surface of the aforementioned blocks engage the downwardly facing tension shoulders 63 and 64. The lower surfaces of these blocks engage the upper ends of the drum sockets 56 and 57. As the upper end of the drum sockets are smaller in size than the downwardly facing torque shoulders 63 and 64, these blocks transmit the tension in the cables 51 and 52 from the drum sockets to the larger area provided by the downwardly facing tension shoulders.

Sleeve means are provided for holding the drum sockets and transfer blocks in the recesses 54 and 55. Preferably, this sleeve means is provided by two separate sleeves 72 and 73. A single sleeve could be utilized, but dual sleeves permit easier assembly. The sleeve 72 is threaded to the mandrel 53 by the thread system 74 and during assembly is moved upwardly over the upper mandrel section 53, to overlie the drum sockets 56 and 57, and hold them in place. The upper sleeve 73 is moved downwardly over the upper end of the drum sockets and over the blocks 65, 66, 67 and 68, to both confine the drum sockets and maintain the transfer blocks in place.

The several components of the mandrel and the components attached thereto are preferably held against relative rotation so that damage to the conductors will not occur. For this purpose, the upper mandrel section 53 has a plurality of recesses 75. The upper sleeve 73 has a corresponding plurality of threaded holes 76 extending therethrough and set screws 77 are threaded into the recesses 75 to lock the upper sleeve 73 in place against both axial and rotative movement.

At its lower end the upper mandrel section 53 is secured to a shear out intermediate mandrel section 78. The upper end of the mandrel section 78 has downwardly facing teeth 79 so that, in the event that the shear pins 81 are sheared, an overshot can be run into the well to engage the teeth 79 and retrieve the lower section of the equipment. The upper mandrel section is provided with slots 84 and 85 into which upwardly projecting fingers 86 and 87 on the threaded section 78 project to key the upper mandrel section 53 against rotation relative to the shear out section 78.

Figure 4:
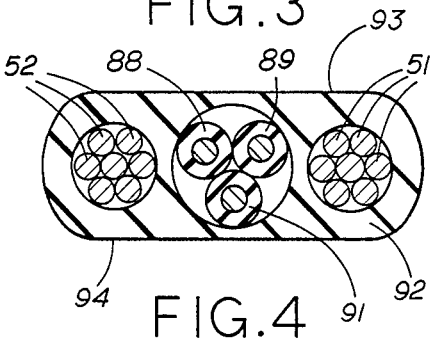
FIG. 4 is a sectional view of a preferred form of multiwire rope-multiconductor cable.

The cable is shown in cross-section in FIG. 4 to include the wire ropes 51 and 52 on either side of multiple conductors 88, 89 and 91. The conductors and cables are contained within an envelope of relatively stiff but flexible material 92. The cable is available from The Kerite Company, Seymour, Connecticut. As shown, at least one side of the cable at its lower end has a flat 93. Preferably, the cable has a pair of flats 93 and 94, which may be engaged to prevent rotation between the mandrel and the cable.

FIG. 2A shows that the cable 35 has the envelope 92 stripped away from the lower end of the cable, leaving bare the conductors and wire ropes.

Figure 3:
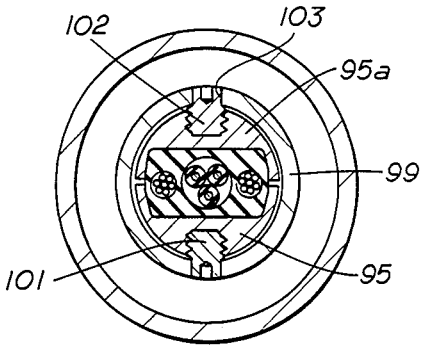
FIG. 3 is a view in section along the lines 3—3 of FIG. 2A.
Figure 5:
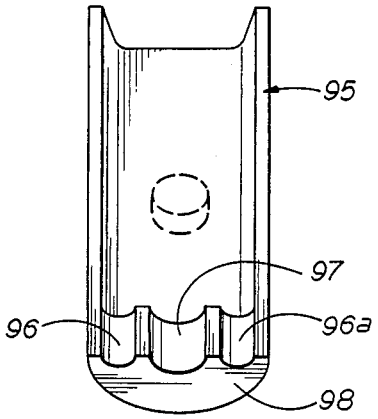
FIG. 5 is a perspective view of the cable seat.

A pair of split cable seats 95 (FIG. 5) are placed about the lower end of the cable with the conductors and wire ropes extending down through the lower semi-circular openings 96, 97 and **96*a*. These openings are in an inturned flange section 98, which bears against the lower end of the envelope 92 of the cable (FIG. 2A). Thus, there are two of these cable seats, 95 and 95*a*, which bear against the cable as shown in FIG. 3 to hold the cable against rotation relative to the seat. The seat is in turn keyed to sleeve 99 by the pair of pins 101 and 102. These pins have a reduced diameter outer section 103, which fits into the lower end of the keyhole slot 104 of the sleeve 99 when the system is assembled. During assembly, the cable seats are placed about the cable and the cable introduced into the sleeve 99. Before the cable is drawn down tightly against the seat, the locking pins 101 and 102 are introduced through the upper larger diameter section of the keyhole 104 and when the seat is moved downwardly relative to the sleeve 99, the locking pins 101 and 102 are trapped in the lower smaller width portion of the keyhole slots 104**.

The sleeve 99 has a counterbore 105 at its upper end for receiving the cable seat, thus providing an upturned shoulder 106, which bears against the lower end of the cable seat when the system is assembled.

A window 107 is provided in the sleeve 99 and the three conductors 88, 89 and 91 pass through this window to the exterior of the sleeve and the upper mandrel section 53.

Figure 17:
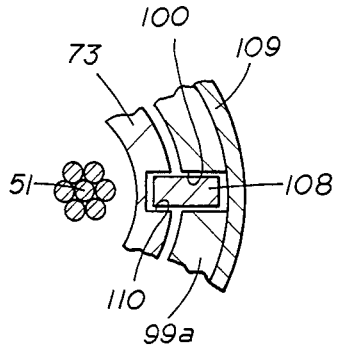
FIG. 17 is a fragmentary sectional view on an enlarged scale taken along the lines 17—17 of FIG. 2B.
Figure 14:
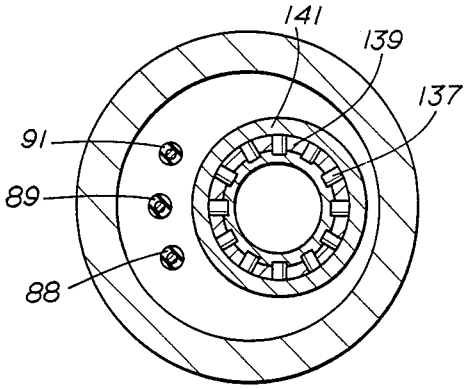
FIG. 14 is a view taken along the lines 14—14 of FIG. 2E.

To provide a space out, the sleeve 99 threadedly engages with the sleeve 73 therebelow so that these two sleeves may be spread apart to place the wire ropes 51 and 52 in tension during assembly. The lower end of sleeve 99 has a reduced diameter section **99*a* and slots 100 in the reduced diameter section which register with slots 110 in the threaded section of the sleeve 73 (FIG. 17). After the wire ropes 51 and 52 have been placed in tension, the two sleeves are rotated to align the aforementioned slots and keys 108 and 108*a* key the two sleeves nonrotatably together. An overlying nut 109 is then threaded upwardly on the sleeve 73 to trap the keys 108 and 108*a*, as shown in FIG. 2B. Thus, the exposed wire ropes 51 and 52 are placed in tension and the cable is held against rotation relative to the mandrel 42**.

Figure 2C:
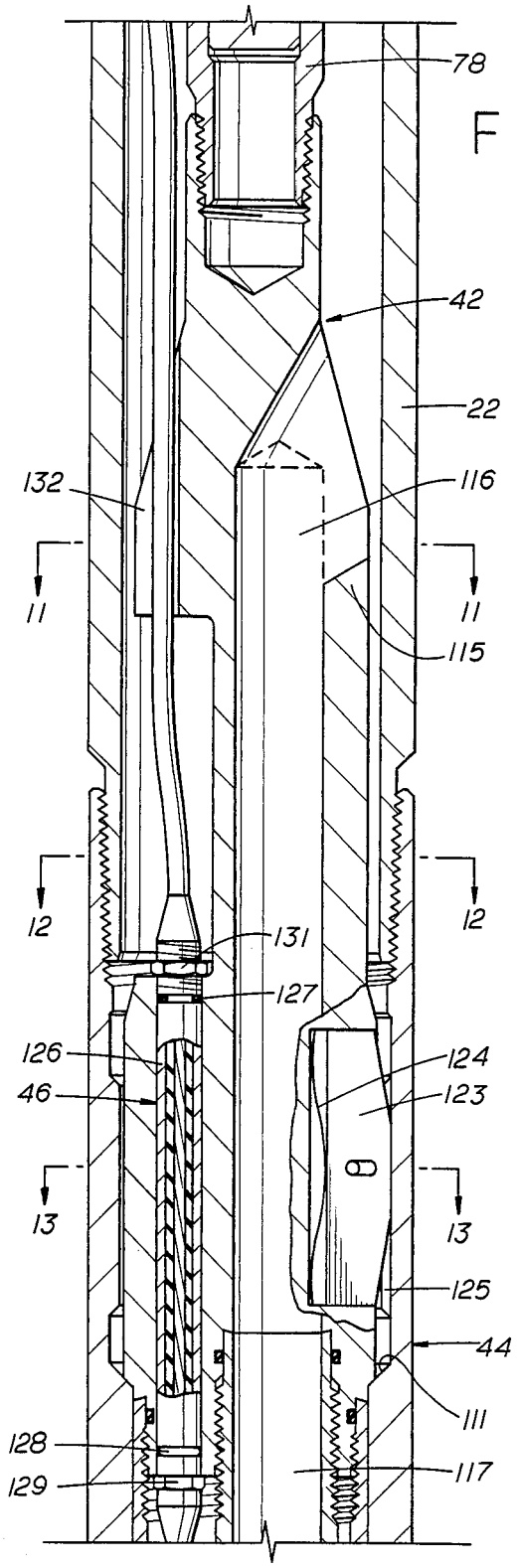
Figure 11:
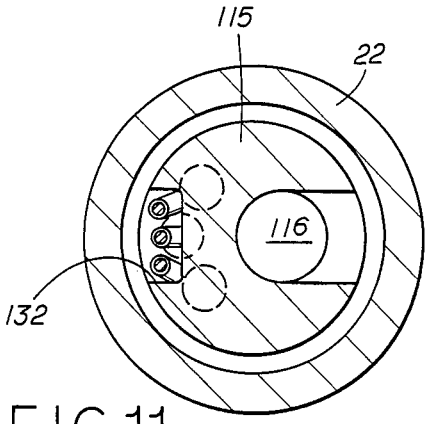
FIG. 11 is a cross-sectional view taken along the lines 11—11 of FIG. 2C.
Figure 12:
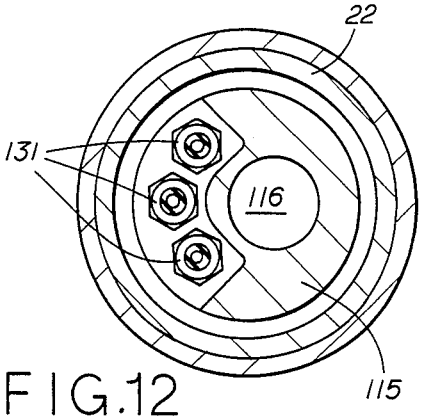
FIG. 12 is a sectional view taken along the lines 12—12 of FIG. 2C.
Figure 2D:
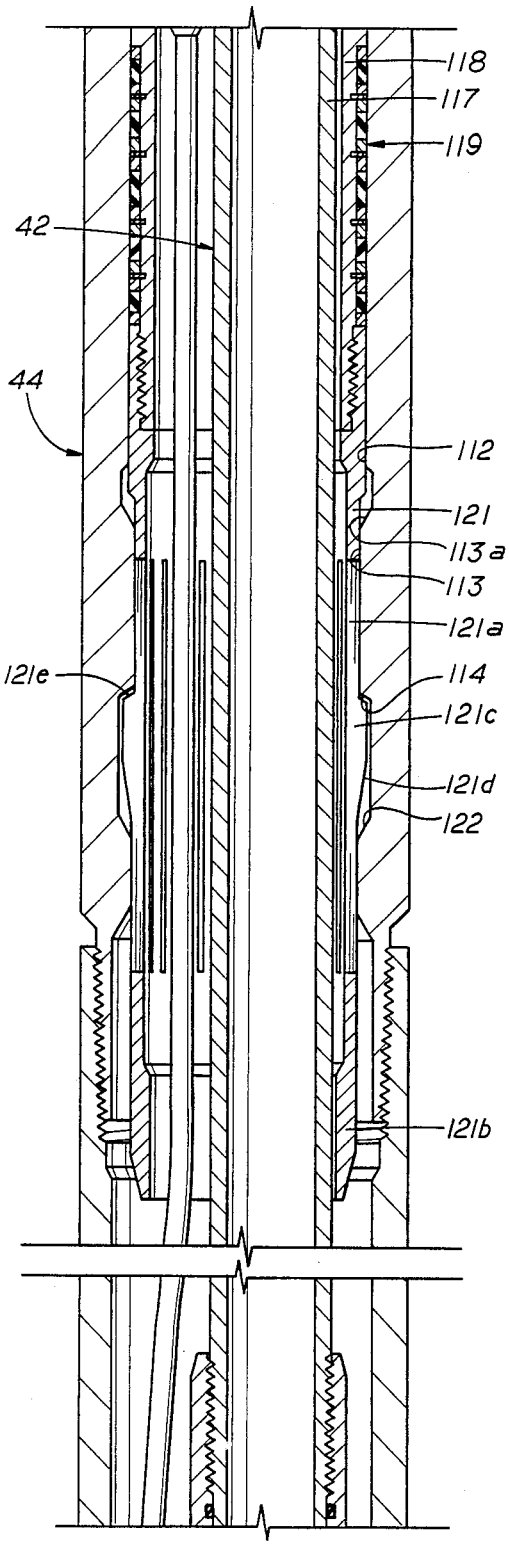

FIGS. 2C and 2D illustrate the special landing nipple 44. This landing nipple includes an upwardly facing no-go shoulder 111, against which the mandrel seats. Below the no-go shoulder, a smooth bore 112 provides a seal area. Below the seal area, an enlarged wall section provides a land 113 which terminates at its lower end in a downwardly facing beveled shoulder 114 for engagement by a collet.

The mandrel 42 continues downwardly from the shear out section 78 and includes a section 115 having an offset bore 116 therethrough. Threadedly secured to the lower end of mandrel section 115 is the through pipe 117.

The mandrel also is provided with the sleeve 118 depending from section 115 on which the seal system indicated generally at 119 is mounted. Depending from the seal sleeve 118 is the double support collet 121 having a plurality of circumferentially arranged collet fingers **121*a* terminating in an annular bottom support 121*b*. The collet fingers have an increased diameter section 121*c*. This increased diameter section results from a downwardly and inwardly inclined surface 121*d*, which engages land 113 as the tool is lowered to collapse the collets inwardly to pass the land 113. After the enlarged section 121*a* of the collet fingers pass the shoulder 114, they snap out into the position shown in FIG. 2D, and the upwardly facing beveled shoulder 121*e* engages the downwardly facing shoulder 114** on the landing nipple to resist upward movement of the mandrel.

The upper beveled shoulder **121*e* is at a substantially larger angle than the lower beveled shoulder 121*d*. This permits easy insertion of the tool into the landing nipple until the enlarged sections 121*c* are received in the groove 122 in the landing nipple. Due to the abrupt incline of shoulder 121*e* however, it is much more difficult to withdraw the tool. For instance, it is preferred that less than a thousand pounds of force be needed to move the tool down to the position shown in FIG. 2D and collapse the fingers as they move into the land 113. To assist in this movement, it is preferred that the inclined shoulder 113*a* at the upper end of land 113 be beveled as shown. In like manner, the downwardly facing shoulder 114** is also beveled. By beveling these shoulders, galling is not a problem.

The seal bore 112 has a substantial length and the lower end of the seal 119 preferably would engage this bore prior to the collet fingers engaging the beveled shoulder **113*a***. Thus, if any problem is encountered in moving the tool downwardly to the latched position, the tubing may be pressurized and the pressure above the tool utilized to force it downwardly and latch the collet fingers in place.

It is preferred that a substantial force be required to move the tool upwardly and compress the collet fingers. This upward force should be at least approximately five thousands pounds and preferably is on the order of ten thousand pounds.

By providing a resistance to upward movement of at least approximately five thousand pounds the cable may be placed in substantial tension and avoid the prior art problems of cable failure adjacent to the tool.

The mandrel section 115 (FIG. 2C) includes a key 123 which is urged outwardly by spring 124 into a slot 125 in the landing nipple 44. This prevents rotation of the entire tool when the motor is operating. If the key and slot are not in register when the tool is run, the reaction force from rotation of the impeller in the motor will rotate the mandrel until the key registers with the slot, at which time it will expand and engage and no further rotation of the mandrel will occur.

Figure 13:
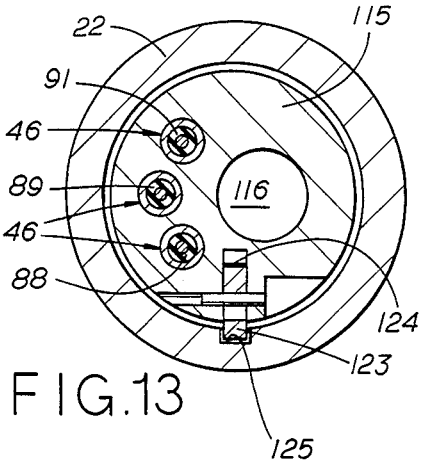
FIG. 13 is a view taken along the lines 13—13 of FIG. 2C.

The mandrel section 115 also has the penetrator 46 for each of the cables. The penetrator is a well known device in which a sleeve 126 receives the conductor and seals with the conductor. The sleeve passes through a bore in the mandrel and upper and lower O-rings 127 and 128 seal between the sleeve and mandrel. The penetrator has a stop 129 on its lower end and a nut 131 threaded onto the upper end of the sleeve to lock the penetrator into place. As shown in FIG. 13, the three conductors pass through separate penetrators in the mandrel section 115.

To protect the conductors, the mandrel section 115 has a groove 132 extending vertically above the penetrator area in which the conductors lie.

Figure 2E:
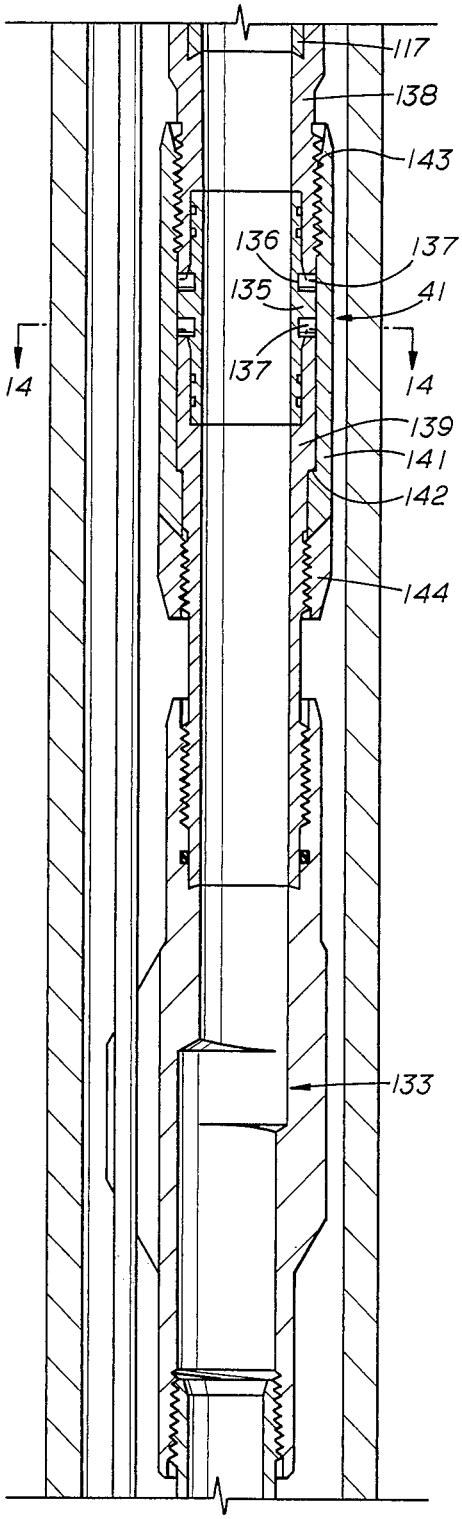
Figure 10:
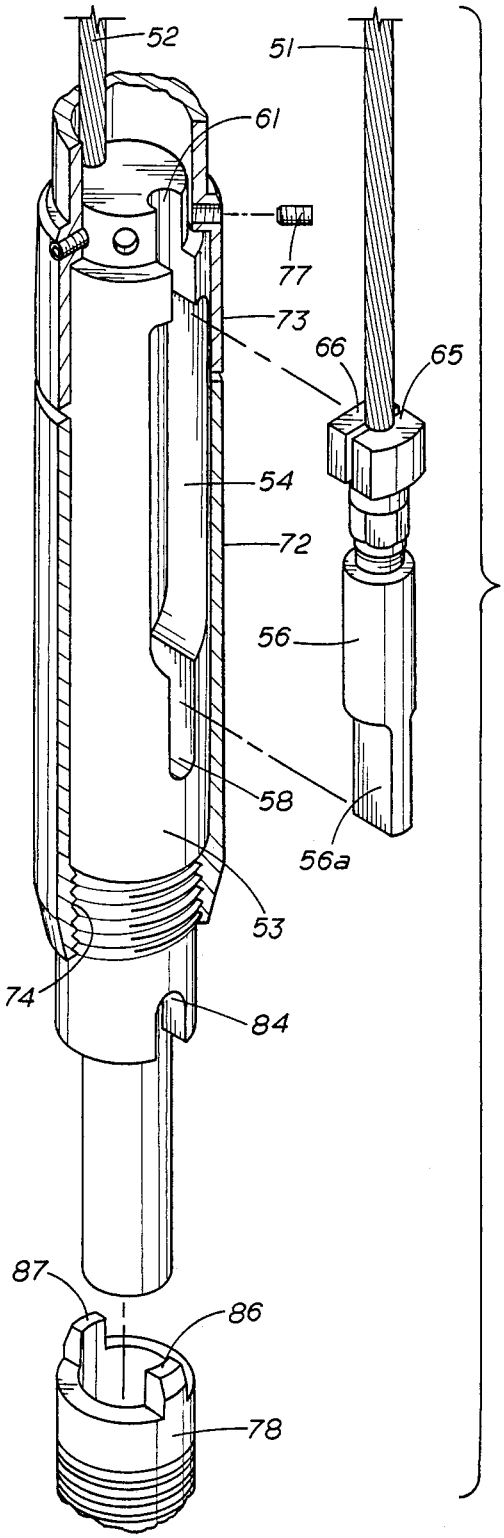
FIG. 10 is an exploded view, partially in elevation and partially in section, of the portion of the mandrel shown in FIG. 2B.

The inner pipe 117, which depends from mandrel section 115, is connected to an offset fitting indicated generally at 133 (FIG. 2E) by the adjustable union indicated generally at 41. This union includes an inner sleeve having a centrally radially extending flange 135. At the upper and lower extremity of this flange, sockets 136 are bored and pins 137 are press fitted into these sockets with the semi-circular outer section of the pins exposed. In other words, the upper pins have their outer upper one-half exposed and the lower pins have their outer lower one-half exposed. The upper pipe connector 138 has a plurality of downwardly facing semi-circular recesses cut therein. These recesses receive the upper half of the pins 137. In like manner, the lower pipe connector 139 has upwardly facing semi-circular recesses cut therein, which receive the lower ring of pins. An outer sleeve 141 has an internal counterbore which fits over the pins and the semi-circular recesses in the upper and lower connectors. This sleeve shoulders against the shoulder 142 and the thread system 143 is utilized to pull the upper and lower pipe sections together with the pipe sections oriented as desired during assembly. A lock nut 144 is threaded against the lower end of the sleeve to lock the sleeve in place.

Figure 15:
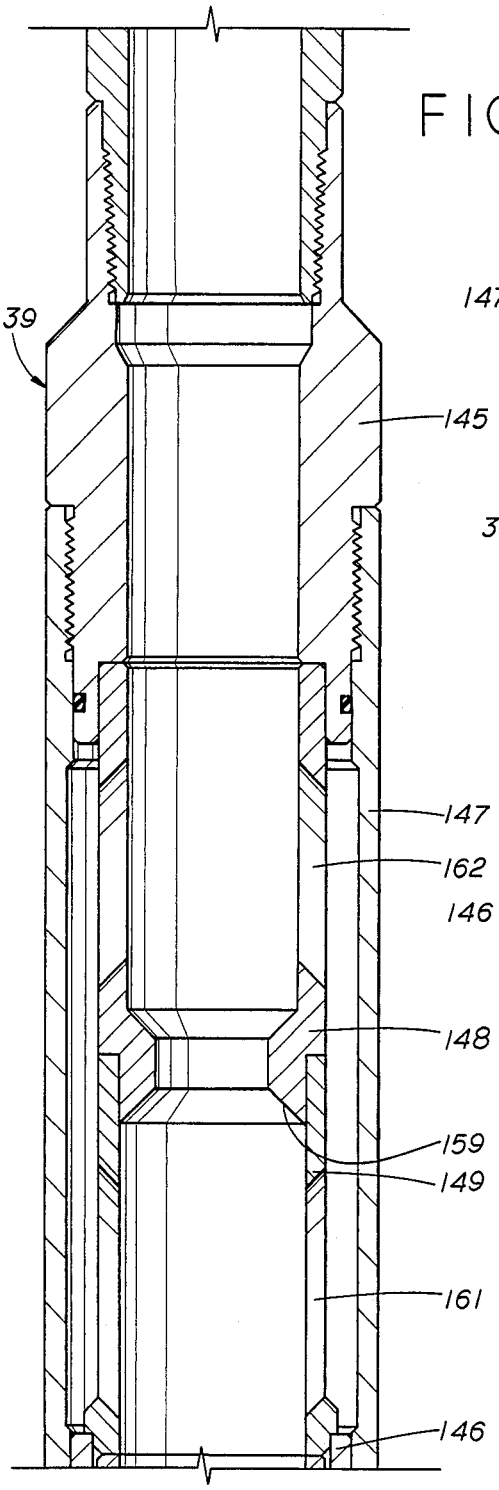
FIGS. 15 and 16 are continuation views in cross-section with the ball shown in elevation of the test and kill valve section of the system.
Figure 16:
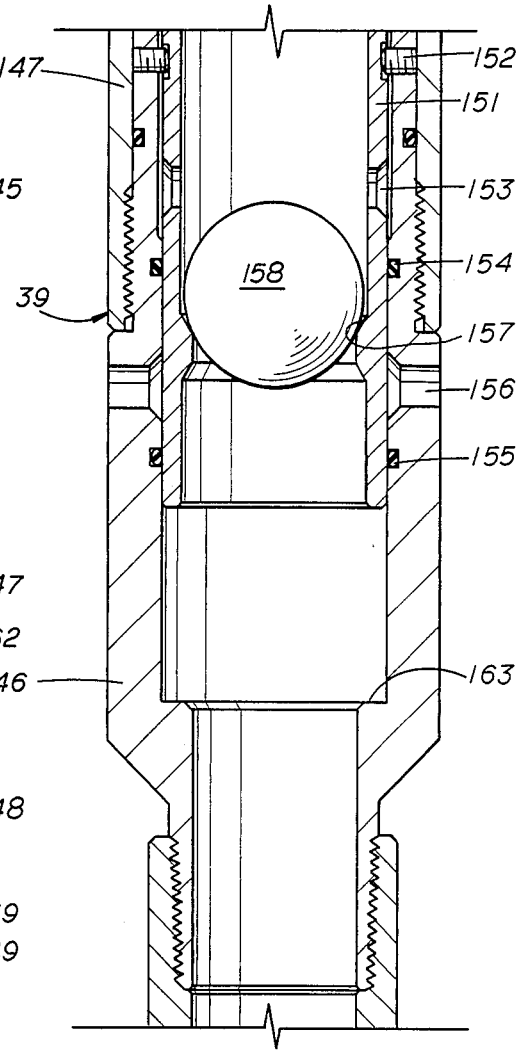

If desired, means may be provided between the mandrel and the motor to test and make certain that the system is fully seated and to provide for kill fluid to be pumped down through the system. Such provision is shown in FIGS. 15 and its continuation view, FIG. 16. An upper sub 145 and a lower sub 146 are secured to each other by an outer sleeve 147. Trapped between the two subs is an upper inner bypass sleeve 148 and an upper cage 149. Below the upper cage, a lower cage and seat 151 is held in place by a plurality of shear pins 152. The lower cage includes a plurality of ports 153 through its wall. When the lower cage is pinned in place by the shear pins 152, these ports 153 are above a pair of O-rings 154 and 155, which straddle a port 156 in the lower sub.

The lower cable and seat has a valve seat 157 on which a ball 158 may seat. When flow is travelling upwardly through the device, the ball 158 is lifted off of its seat and engages the surface 159 at the top of the cage and flow bypasses the ball through the ports 161. This flow is contained by the outer sleeve 147 and returns to the inner bore though the tool through ports 162. When it is desired to test the tool, pressure in the tubing passes downwardly through the mandrel and forces the ball 158 against its seat 157. If the tool is not fully on its seat, pressure in the tubing above the mandrel will be exerted on the mandrel to drive it down to fully seated position. In either event, the tool was originally seated or will be seated by pressure and the pressure will indicate that the tool is fully seated and the seals are operative.

If it is desired to pump kill fluid down the well, the pressure in the tubing above the assembly is increased to a value which will shear the pins 152 and drive the lower cage and seat 151 downwardly until it engages the upturned shoulder 163. At this time, the ports 153 and 156 will be in register and kill fluid may be pumped downwardly into the well.

The assembly of the various components of the tool is believed to be apparent from the foregoing description. It is pointed out, however, that the cables 51 and 52, after being stripped of the envelope of flexible material, may be passed through the space out sleeves and then the drum sockets attached to the cables. The drum sockets may then be readily moved radially inwardly into the mandrel and held in place by the retaining sleeve.

The various components of the structure are held in alignment and against rotation either by a fully made up thread in joints between various sections or by keys, set screws or the like so that, once fully assembled, no relative rotation is possible between the motor and the cable to thus protect the conductors in the area between the cable and the motor.

The cable is further protected by being hung in tension so that the weight of the cable will not cause failure adjacent to the point of connection of the cable to the tool.

The foregoing disclosure and description of the invention are illustrative and explanatory thereof and various changes in the size, shape and materials, as well as in the details of the illustrated construction, and various changes in the process, may be made within the scope of the appended claims without departing from the spirit of the invention.

What is claimed is:

1. The method of installing, operating, and retrieving a pump at a downhole location in a well having a wellhead with tubing suspended therefrom comprising:

running in the pump on a mandrel which is supported on a cable, releasably latching the mandrel to the tubing, placing the cable in tension with a selected force sufficient to urge the mandrel upward but insufficient to release the mandrel, securing the cable to the wellhead while maintaining the cable in tension and operating the pump, thereafter releasing the mandrel from the tubing by pulling on the cable with a force greater than said selected force, and retrieving the cable.

2. A pump system comprising:

a tubing, a landing nipple forming a part of the tubing and having an upwardly facing no-go shoulder and a downwardly facing latch shoulder, a multiconductor-wire rope cable in said tubing, a mandrel suspended from said cable, a pump carried by said mandrel and attached to said multiconductors, a downwardly facing no-go shoulder on said mandrel supporting said mandrel on said landing nipple no-go shoulder, means on said mandrel engaging said landing nipple and preventing rotation of said mandrel, seal means on said mandrel sealingly engaging said landing nipple.

releasable means on said mandrel engaging said landing nipple downwardly facing shoulder and preventing upward movement of said mandrel in response to an upward pull on said cable less than a selected value, said releasable means released by an upward pull on said cable above said selected value, and means between the upper end of said tubing and said cable maintaining said cable in tension with a force less than said selected value.

3. A pump system for a well comprising:

a multiconductor-wire rope cable, a mandrel suspended from said cable, a pump carried by said mandrel and attached to said multiconductors, a no-go shoulder on said mandrel for supporting the mandrel on a tubing shoulder, means on said mandrel for engaging a tubing and preventing rotation of said mandrel, seal means on said mandrel for sealing with a tubing, a collet on said mandrel with collet fingers supported on each end and having downwardly facing shoulders at a shallow angle for depressing said fingers as they pass through an internal land in a tubing and upwardly facing shoulders at a relatively steep angle for engaging a downwardly facing shoulder in a tubing and latching said mandrel in the tubing, and said upwardly facing shoulders at a sufficiently steep angle to require a force of at least five thousand pounds to depress the collet fingers in passing said downwardly facing shoulder in a tubing.

4. The pump system of claim 3, wherein a force of less than approximately one thousands pounds is required to depress said fingers as they engage and pass said land and a force of at least five thousand pounds is required to depress said fingers as they engage and pass said downwardly facing shoulder in a tubing.

5. The pump system of claim 4, wherein the force required to depress said fingers as they engage and pass said downwardly facing shoulder in a tubing is approximately ten thousand pounds.

6. The pump system of claim 3, wherein the force required to depress said fingers as they engage and pass said downwardly facing shoulder in a tubing is at least five times the force required to depress said fingers as they engage and pass said land.

7. The pump system of claim 6, wherein said first mentioned force is approximately ten times said last mentioned force.

8. A pump system as in claim 2, 3, 4, 5, 6 or 7, wherein:

said pump is suspended from said mandrel, said mandrel is formed of multiple sections, means between each section of said mandrel prevent relative rotation between the mandrel sections, and means between said cable and mandrel prevent relative rotation between said cable and mandrel.

9. A connection between a multiwire rope cable and a mandrel comprising:

a mandrel having a locking section with multiple recesses opening to the outer periphery of the mandrel, a tang slot forming the bottom of each recess, a cable slot forming the top of each recess, downwardly facing tension shoulders at the lower end of each cable slot, a drum socket in each recess, said drum socket having a tang nonrotatably received in said tang socket, tension transfer blocks between said drum sockets and tension shoulders, and sleeve means releasably secured on said mandrel and overlying said multiple recesses to maintain said drum sockets in said recesses.

10. The connection of claim 9 in combination with:

a multiconductor-multiwire rope cable having the conductors and cable contained within an envelope of stiff but flexible material having at least one flat side at one end of the cable;

said multiple conductors and multiple wire ropes extending from said end of said cable;

said wire ropes secured to said drum sockets;

said sleeve means including, upper sleeve means having cable seat means at its upper end engaging said flat side and preventing relative rotation between said upper sleeve means and said cable, means between said mandrel and upper sleeve means preventing relative rotation therebetween, space out means for adjusting the effective length of said upper sleeve means and preventing relative rotation of the sleeve means above and below said space out means, said mandrel having a seal section for sealing with a tubing, an exit opening in the wall of said upper sleeve means through which the multiple conductors extend; and said seal section including penetrator means through which said multiple conductors extend.

11. The connector of claim 10 in combination with:

means for engaging a tubing to prevent rotation of the connector in the tubing, and releasable means for releasably locking said mandrel in a tubing and preventing upward movement of the mandrel, said releasable means rendered ineffective by an upward pull on said cable above a selected value.

12. The connector of claim 11, in combination with:

a tubing in which the mandrel is suspended by said cable, and means between the upper end of said tubing and said cable maintaining said cable in tension with a force less than said selected value.

13. The connector of claim 9, 10 or 11, in combination with a check valve means preventing downward flow through the mandrel up to a selected pressure differential across the check valve and permitting flow pass the check valve when the differential exceeds the selected value.

* * * * *